US011046097B2

(12) United States Patent
Jariabka et al.

(10) Patent No.: US 11,046,097 B2
(45) Date of Patent: Jun. 29, 2021

(54) MEDIA RETRACTION

(71) Applicant: Hewlett-Packard Development Company, L.P., Houston, TX (US)

(72) Inventors: Keith Jariabka, Vancouver, WA (US); Kyle Loucks, Vancouver, WA (US); Mark Groenenboom, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 206 days.

(21) Appl. No.: 15/748,902

(22) PCT Filed: Oct. 28, 2015

(86) PCT No.: PCT/US2015/057856
§ 371 (c)(1),
(2) Date: Jan. 30, 2018

(87) PCT Pub. No.: WO2017/074361
PCT Pub. Date: May 4, 2017

(65) Prior Publication Data

US 2018/0222224 A1 Aug. 9, 2018

(51) Int. Cl.
*B65H 3/06* (2006.01)
*B65H 5/06* (2006.01)
(Continued)

(52) U.S. Cl.
CPC ..... *B41J 13/103* (2013.01); *B41J 13/0018* (2013.01); *B41J 13/106* (2013.01); *B65H 3/06* (2013.01); *B65H 3/0661* (2013.01); *B65H 3/565* (2013.01); *B65H 5/06* (2013.01); *B65H 2403/51* (2013.01)

(58) Field of Classification Search
CPC .... B41J 13/0018; B41J 13/103; B41J 13/106; B65H 3/06; B65H 5/06; B65H 3/0661; B65H 3/565; B65H 2403/51
See application file for complete search history.

(56) References Cited

U.S. PATENT DOCUMENTS 5,316,285 A * 5/1994 Olson ..... B65H 3/06 271/121
5,397,191 A 3/1995 Murakami et al.
(Continued)

FOREIGN PATENT DOCUMENTS

| | | | | |
|---|---|---|---|---|
| EP | 0549989 | | 7/1993 | |
| JP | 2005-112492 | * | 4/2005 | ..... B65H 1/14 |
| JP | 2005112492 | | 4/2005 | |

OTHER PUBLICATIONS

International Searching Authority, "Search Report," issued in connection with PCT patent application No. PCT/US2015/057856, dated Jul. 25, 2016, 6 pages.
(Continued)

*Primary Examiner* — Matthew G Marini
*Assistant Examiner* — Marissa Ferguson-Samreth
(74) *Attorney, Agent, or Firm* — Dicke Billig & Czaja PLLC

(57) ABSTRACT

A media retraction system includes a loadstop shaft rotatable about an axis thereof, and a loadstop paddle rotatably coupled with and slidably mounted on the loadstop shaft such that the loadstop paddle is slidable about the axis of the loadstop shaft.

20 Claims, 9 Drawing Sheets

(51) Int. Cl.

| | |
|---|---|
| ***B41J 13/10*** | (2006.01) |
| ***B65H 3/56*** | (2006.01) |
| ***B41J 13/00*** | (2006.01) |

(56) References Cited

U.S. PATENT DOCUMENTS

| | | | | |
|---|---|---|---|---|
| 5,655,762 | A * | 8/1997 | Yergenson | B65H 3/0661 271/121 |
| 5,890,821 | A * | 4/1999 | Lesniak | B41J 13/106 271/10.01 |
| 5,997,198 | A | 12/1999 | Murayama et al. | |
| 6,145,831 | A | 11/2000 | Inoue et al. | |
| 6,217,017 | B1 * | 4/2001 | Yamazaki | B65H 3/5223 271/121 |
| 6,708,971 | B1 | 3/2004 | Sasaki et al. | |
| 6,877,737 | B2 * | 4/2005 | Yanagi | B41J 13/103 271/121 |
| 6,877,738 | B2 * | 4/2005 | Sonoda | B65H 3/0607 271/121 |
| 7,370,858 | B2 | 5/2008 | Youn | |
| 7,513,495 | B2 | 4/2009 | Mo | |
| 7,530,562 | B2 * | 5/2009 | Ohshima | B65H 3/56 271/122 |
| 7,665,724 | B2 * | 2/2010 | Bingham | B65H 3/0607 271/118 |
| 8,393,614 | B2 * | 3/2013 | Mitamura | G03G 15/60 271/110 |
| 8,915,495 | B2 | 12/2014 | Jariabka et al. | |
| 9,045,298 | B2 * | 6/2015 | Shin | B65H 3/0607 |
| 2005/0017434 | A1 | 1/2005 | Yamanaka et al. | |

OTHER PUBLICATIONS

International Searching Authority, "Written Opinion," issued in connection with PCT patent application No. PCT/US2015/057856, dated Jul. 25, 2016, 9 pages.

* cited by examiner

MEDIA RETRACTION

BACKGROUND

A printer may use sheets of media from a stack. As a top sheet of the media is drawn or "picked" from the stack, a next-to-top sheet (or sheets) may be inadvertently drawn with the top sheet. If left uncleared, such next sheet(s) may result in a sheet misfeed during a subsequent pick cycle.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1:
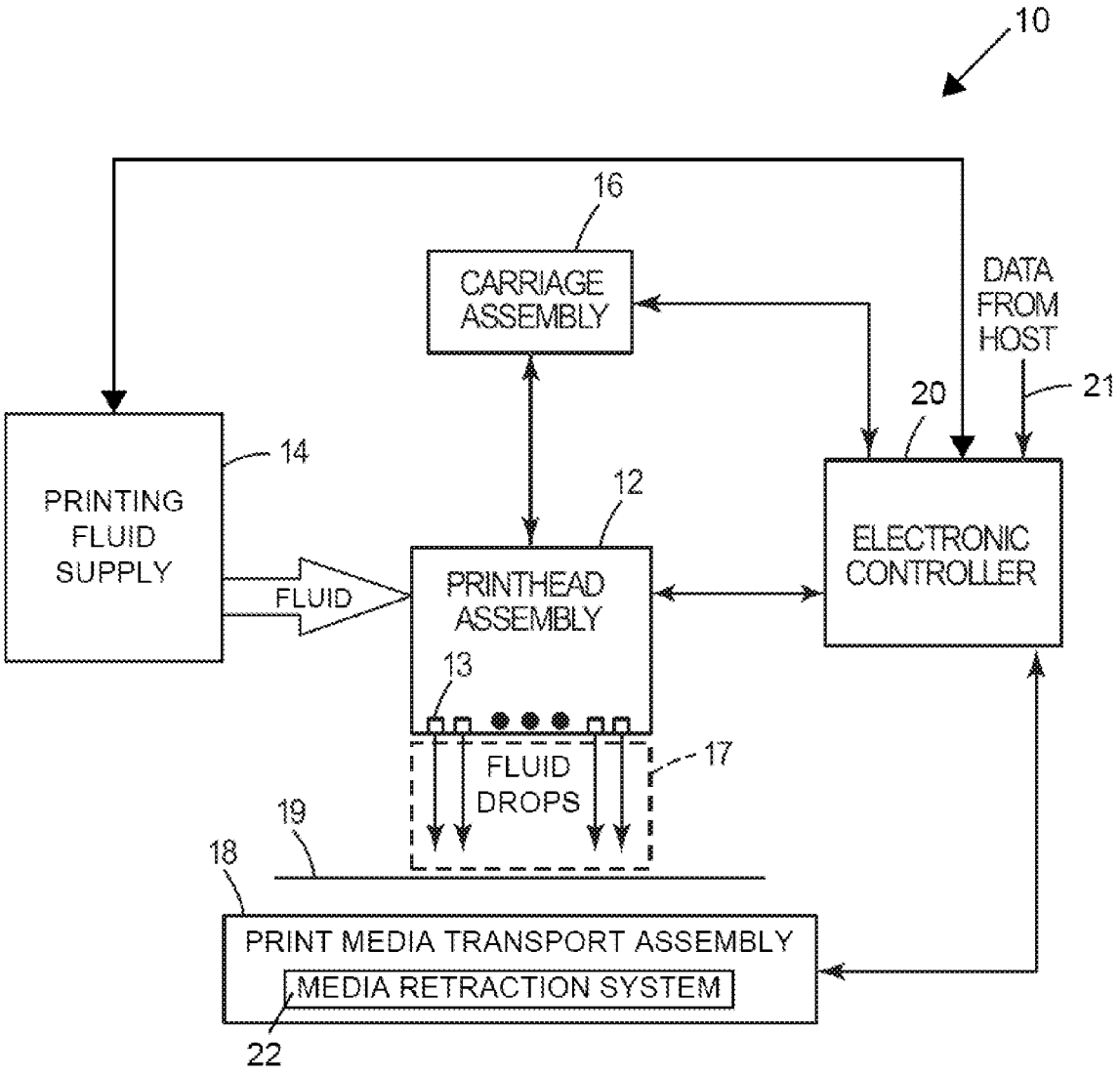
FIG. 1 is a block diagram illustrating an example of a printing system.

FIG. 1 illustrates an example of a printing system, such as inkjet printing system 10. Inkjet printing system 10 includes a fluid ejection assembly, such as printhead assembly 12, and a fluid supply assembly, such as printing fluid supply 14. In the illustrated example, inkjet printing system 10 also includes a carriage assembly 16, a print media transport assembly 18, and an electronic controller 20.

Printhead assembly 12 includes at least one printhead or fluid ejection device which ejects drops of printing fluid or other fluid through a plurality of orifices or nozzles 13. In one example, the drops are directed toward a medium, such as print media 19, so as to print onto print media 19 as printhead assembly 12 and print media 19 are moved relative to each other. Print media 19 includes, for example, any type of suitable sheet material, such as paper, card stock, transparencies, Mylar, fabric, and the like, packaging material, or other printable material.

Printing fluid supply 14 supplies printing fluid to printhead assembly 12. In one example, printhead assembly 12 and printing fluid supply 14 are housed together in an inkjet or fluid-jet print cartridge or pen. In another example, printing fluid supply 14 is separate from printhead assembly 12 and supplies printing fluid to printhead assembly 12 through an interface connection, such as a supply tube.

Carriage assembly 16 positions printhead assembly 12 relative to print media transport assembly 18 and print media transport assembly 18 positions print media 19 relative to printhead assembly 12. Thus, a print zone 17 is defined adjacent to nozzles 13 in an area between printhead assembly 12 and print media 19. Print media transport assembly 18 may include, for example, a variety of guides, rollers, wheels, etc. for the handling and/or routing of print media 19 through inkjet printing system 10, including transporting, guiding, and/or directing print media 19 to and/or away from print zone 17. In one example, print media transport assembly 18 includes a media retraction system, as identified at 22, for retracting misfed media within inkjet printing system 10.

In one implementation, electronic controller 20 communicates with printhead assembly 12, printing fluid supply 14, carriage assembly 16, and print media transport assembly 18. Electronic controller 20 receives data 21 from a host system, such as a computer, and may include memory for temporarily storing data 21. Data 21 represents, for example, a document and/or file to be printed. As such, data 21 forms a print job for inkjet printing system 10 and includes print job commands and/or command parameters. In one example, electronic controller 20 provides control of printhead assembly 12 including timing control for ejection of printing fluid drops from nozzles 13. As such, electronic controller 20 defines a pattern of ejected printing fluid drops which form characters, symbols, and/or other graphics or images on print media 19. Timing control and, therefore, the pattern of ejected printing fluid drops, is determined by the print job commands and/or command parameters.

Figure 2:
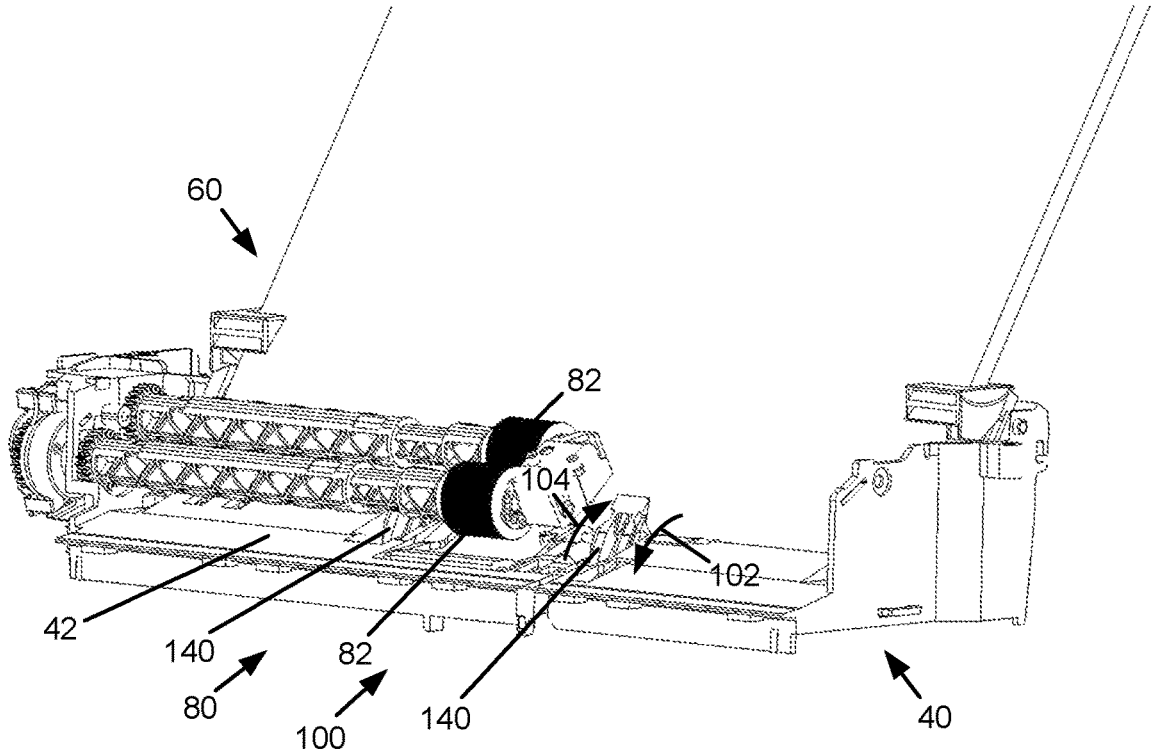
FIG. 2 illustrates an example of a portion of a media transport assembly for a printing system.

FIG. 2 illustrates an example of a portion of a print media transport assembly, such as print media transport assembly 18 (FIG. 1), for a printing system, such as inkjet printing system 10 (FIG. 1). In one implementation, the print media transport assembly includes a chassis 40, a media tray (input tray) 60 for supporting a media stack, a pick system 80, including pick tires 82, for drawing or "picking" a sheet of media from the media stack, and a media retraction system 100, including loadstop levers or paddles 140, for gathering and returning mis-picked or misfed media to the media stack.

In one implementation, media tray 60 is an upright tray having an incline or slope. In other implementations, media tray 60 may be horizontal or include other slopes. The media stack includes media, such as print media 19 (FIG. 1), and, in one example, includes, but is not limited to, sheet paper. The media stack is defined as an amount of media disposed within media tray 60. In one example, the printing system is a "top-in, front-out" printer, with media being loaded generally vertically in media tray 60 and being output through a front of the printing system after being fed through the printing system.

In the example illustrated in FIG. 2, media retraction system 100 includes two spaced loadstop paddles 140. Loadstop paddles 140 may be disposed on a single axle or shaft supported within chassis 40. While two loadstop paddles 140 are illustrated, more or fewer loadstop paddles 140 may be utilized.

As further described herein, loadstop paddles 140 move or transition between a plurality of positions including, for example, a non-obstructing position, a plurality of gathering or retracting positions, and an obstructing position.

In the non-obstructing position, loadstop paddles 140 are moved out of the media path, thereby allowing picked media to enter the media path. In one implementation, loadstop paddles 140 arrive at the non-obstructing position by, for example, rotating away from media tray 60 in a direction indicated by arrow 102 and rotating, in one example, under plate or surface 42 of chassis 40.

In the gathering or retracting positions, loadstop paddles 140 are moved toward media tray 60 (i.e., toward the media stack) to "gather" or "retract" misfed media back into media tray 60. In one implementation, loadstop paddles 140 move through the gathering or retracting positions by, for example, rotating toward media tray 60 in a direction indicated by arrow 104.

In the obstructing position, loadstop paddles 140 are further moved toward media tray 60 (i.e., toward the media stack) and, in one example, fully extended into the media path to push the misfed media back into the media stack and, in one example, compress the media stack. In one implementation, loadstop paddles 140 arrive at the obstructing position by, for example, further rotating toward media tray 60 in the direction indicated by arrow 104. In one implementation, loadstop paddles 140 remain in the obstructing position, and thereby prevent media from entering the media path, until a pick cycle is started.

In one implementation, movement of loadstop paddles 140 away from media tray 60 (for example in the direction indicated by arrow 102) may be in response to rotation of a supporting shaft in one direction, and movement of loadstop paddles 140 toward media tray 60 (for example in the direction indicated by arrow 104) may be in response to rotation of the supporting shaft in an opposite direction.

Figure 3:
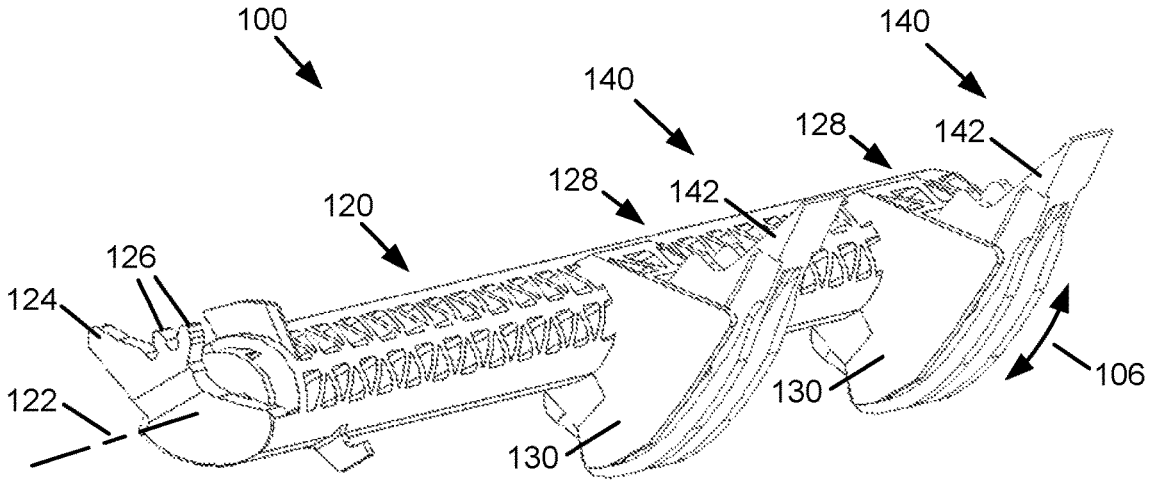
FIG. 3 illustrates an example of a portion of a media retraction system.

FIG. 3 illustrates an example of a portion of a media retraction system, such as media retraction system 100, for a printing system, such as inkjet printing system 10 (FIG. 1). In one example, media retraction system 100 includes a loadstop shaft 120 and, as described above, loadstop levers or paddles 140.

In one example, loadstop shaft 120 includes an axis 122 and is mounted for rotation about axis 122 in, for example, chassis 40 (FIG. 2). In one example, loadstop shaft 120 includes a lever arm 124 and gear teeth 126 which interact or mate with a cam surface or teeth to rotate or position loadstop shaft 120 and loadstop paddles 140, as described below.

In one example, loadstop shaft 120 includes spaced pockets or channels 128 for loadstop paddles 140. In one example, and as illustrated, one pocket or channel 128 is provided toward an end of loadstop shaft 120 to support one loadstop paddle 140 and another pocket or channel 128 is provided intermediate of the ends of loadstop shaft 120 to support another loadstop paddle 140. In one example, respective pockets or channels 128 are defined by spaced supports or flanges 130 which extend from loadstop shaft 120. In one implementation, supports or flanges 130 extend orthogonal or tangential to loadstop shaft 120 such that pockets or channels 128 are oriented orthogonal to and radially offset from axis 122 of loadstop shaft 120.

As further described below, loadstop paddles 140 are supported within pockets or channels 128 for rotation with loadstop shaft 120 and are supported within pockets or channels 128 for sliding relative to loadstop shaft 120 including, more specifically, sliding relative to supports or flanges 130, as indicated by double arrow 106. In one example, loadstop paddles 140 include respective ends or tips 142 to contact and catch or gather media, as described below. In one example, tips 142 have a serrated surface to contact and catch a leading edge of the media.

FIGS. 4, 5, 6, 7 illustrate examples of a portion of media retraction system 100, including a portion of loadstop shaft 120 with one pocket or channel 128 (of multiple pockets or channels 128) and a respective loadstop paddle 140 (of multiple loadstop paddles 140). In one example, pocket or channel 128 is defined or formed by spaced supports or flanges 130 extended orthogonal to axis 122 of loadstop shaft 120. As such, spaced supports or flanges 130 define or form opposite sides of pocket or channel 128 such that pocket or channel 128 is open orthogonal to loadstop shaft 120. In one example, and as further described below, loadstop paddle 140 slides within pocket or channel 128 relative to supports or flanges 130, as indicated by double arrow 106.

In one example, pocket or channel 128 and loadstop paddle 140 include mating features to retain and guide loadstop paddle 140 within pocket or channel 128. In one implementation, the mating features include a slot 144 formed in a side of loadstop paddle 140, and a post or tab 132 and a post or tab 134 both protruded from an adjacent side of pocket or channel 128 including, more specifically, an adjacent side of a corresponding support or flange 130 of pocket or channel 128. As such, in one example, post or tab 132 and post or tab 134 both slide within slot 144 to retain and guide loadstop paddle 140 within pocket or channel 128, as described below.

In one example, slot 144 is formed within or along an outer surface of a side of loadstop paddle 140 and open outward to the side of loadstop paddle 140, and tab 132 and tab 134 are both extended or projected inward from an inner surface of a side of pocket or channel 128 including, more specifically, an inner surface or side of a corresponding support or flange 130 of pocket or channel 128. In one example, slot 144 is formed within or along both sides of loadstop paddle 140, and post or tab 132 and post or tab 134 are both extended or projected from both sides of pocket or channel 128 including, more specifically, both supports or flanges 130 of pocket or channel 128.

In one implementation, slot 144 is a non-linear slot and includes a non-linear profile to impart or establish a non-linear path of loadstop paddle 140 relative to loadstop shaft 120 including, more specifically, relative to pocket or channel 128 of loadstop shaft 120. As such, with contact of media, as described below, loadstop paddle 140 is slidable relative to and about axis 122 of loadstop shaft 120 so as to follow a curved, non-linear path, as represented by dashed line 107. Thus, in one example, loadstop paddle 140 is constrained to an "engineered path" or "spline" that is similar to a curve with a floating pivot.

In one example, loadstop paddle 140 is biased to extend beyond supports or flanges 130 such that tip 142 of loadstop paddle 140 extends radially away from axis 122 of loadstop shaft 120, in the direction indicated by arrow 108. In one implementation, loadstop paddle 140 is biased by a spring 150 positioned between loadstop shaft 120 and loadstop paddle 140. In one example, spring 150 is positioned between a post or protrusion 136 of shaft 120 and a post or protrusion 146 of loadstop paddle 140.

FIGS. 8A, 8B, 8C, 8D, 8E illustrate examples of states or positions of a media retraction system, such as media retraction system 100, for catching or gathering a sheet of media and retracting or returning the sheet of media to a media stack. In one example, in addition to loadstop shaft 120 and loadstop paddles 140, media retraction system 100 includes a cam gear member 160 to establish or achieve various states or positions of media retraction system, including, more specifically, various states or positions of loadstop shaft 120 and loadstop paddles 140 for catching or gathering a sheet of media and retracting or returning the sheet of media to a media stack, including before, during, and after catching or gathering the sheet of media and retracting or returning the sheet of media to the media stack. As described above, loadstop paddles 140 are slidably mounted within pockets or channels 128 and are biased in the direction indicated by arrow 108.

In one implementation, cam gear member 160 includes teeth 162 around, for example, a periphery thereof for driving or rotating cam gear member 160, and includes a series of cam surfaces 164 and gear teeth 166 for interacting with lever arm 124 and gear teeth 126 of loadstop shaft 120 (FIG. 3). As such, rotation of cam gear member 160 imparts a sequence of different rotations of loadstop shaft 120 and movements of loadstop paddles 140 as supported by loadstop shaft 120, including rotation of loadstop paddles 140.

Figure 8A:
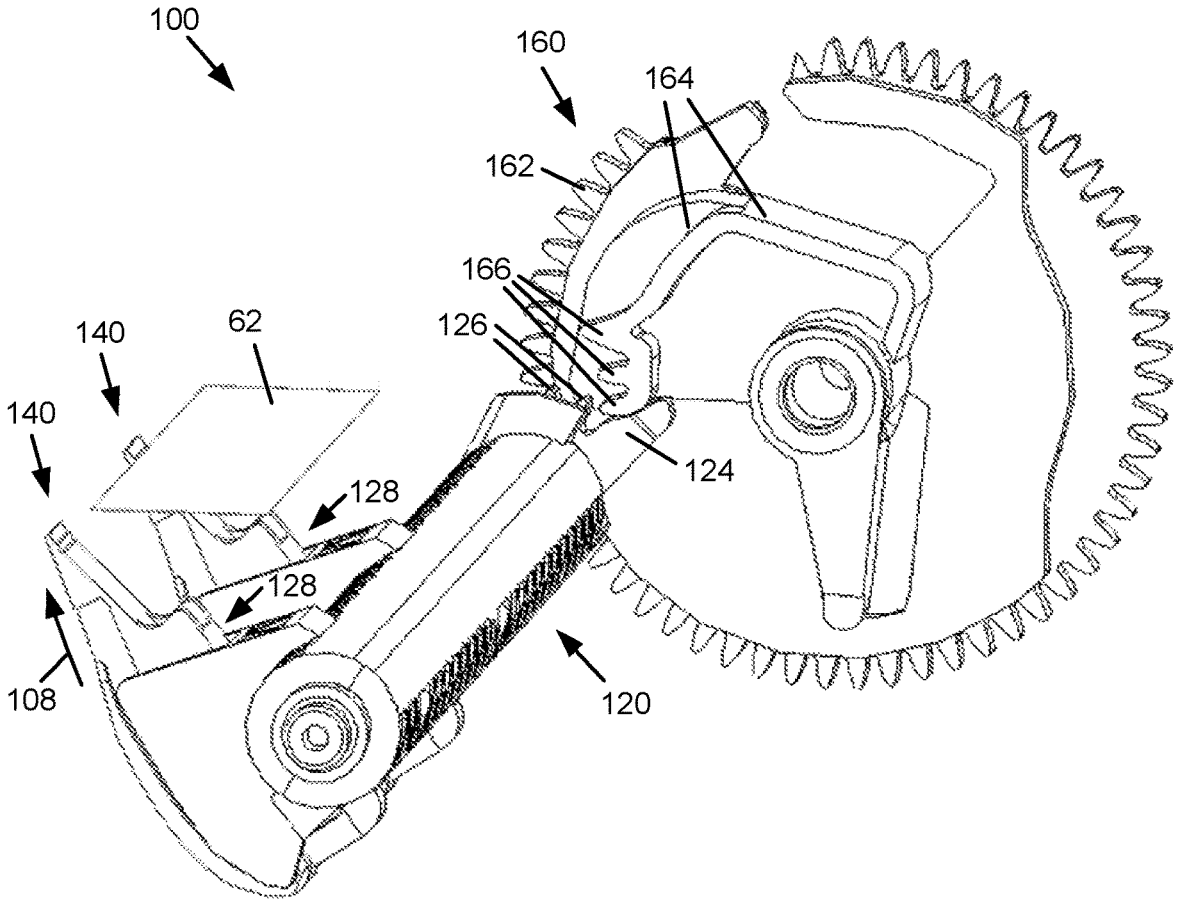
FIGS. 8A, 8B, 8C, 8D, 8E illustrate examples of positions of a media retraction system in retracting media.

In one example, as illustrated in FIG. 8A, loadstop shaft 120 is positioned (e.g., has been rotated) such that loadstop paddles 140 including, more specifically, tips 142 of loadstop paddles 140 are in the non-obstructing position (e.g., below plate or surface 42 of chassis 40 (FIG. 2)). As such, a first or top sheet of media from the media stack may be drawn or "picked" and loaded or "fed" into the media path by, for example, pick system 80 (FIG. 2).

In one example, as the top sheet of media is "picked" from the media stack, a next-to-top sheet 62 (or multiple next-to-top sheets) may be drawn, at least partially, into the media path by, for example, frictional forces between the top sheet and next-to-top sheet 62. In one example, next-to-top sheet 62 is supported at least partially by, or extended at least partially over, plate or surface 42 of chassis 40 (FIG. 2). In the examples of FIGS. 8A, 8B, 8C, 8D, 8E, next-to-top sheet 62 is only partially illustrated to permit illustration of media retraction system 100.

Figure 8B:
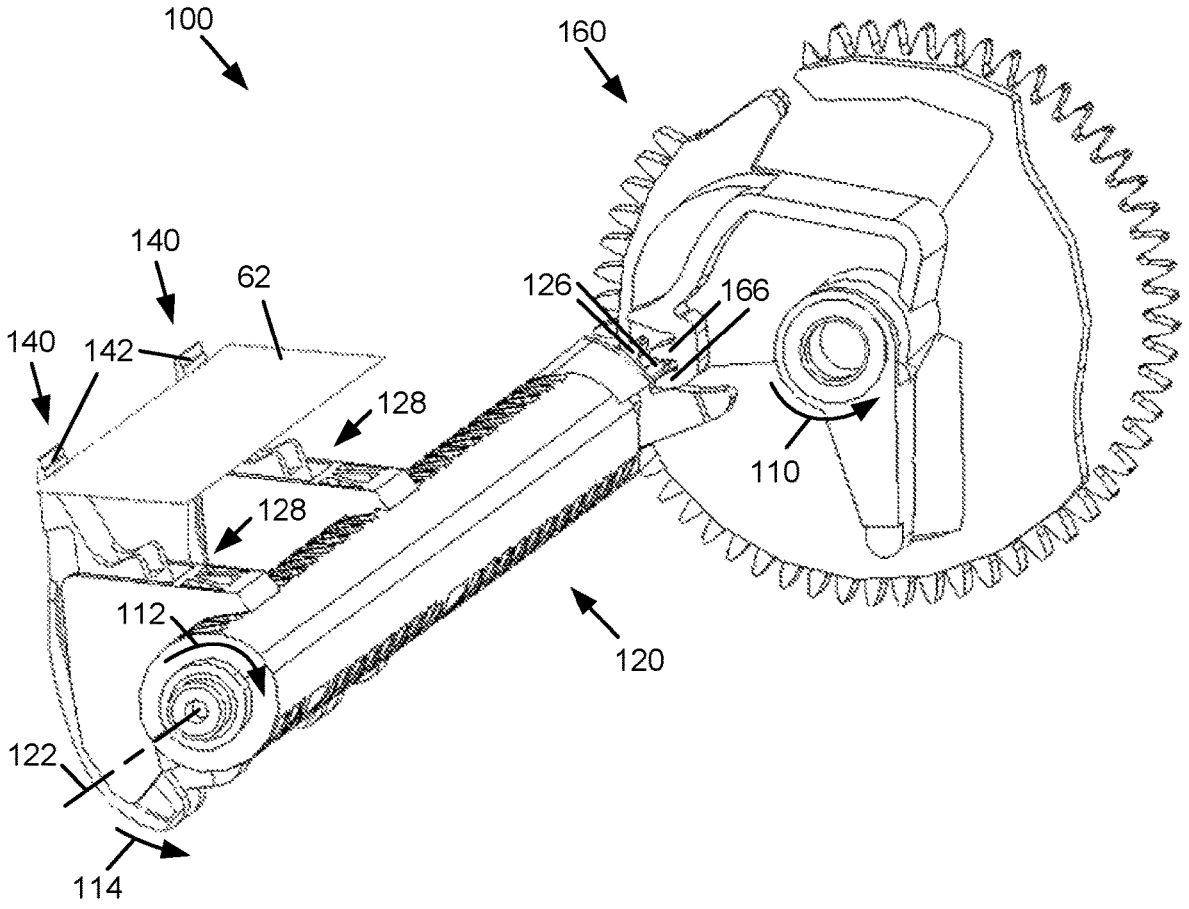

In one example, as illustrated in FIG. 8B, to initiate a sequence of media retraction system 100 in retracting next-to-top sheet 62 and returning next-to-top sheet 62 to the media stack, cam gear member 160 is rotated. In one example, as cam gear member 160 is rotated, as indicated by arrow 110, gear teeth 166 of cam gear member 160 engage and mesh with gear teeth 126 of loadstop shaft 120 such that loadstop shaft 120 is rotated about axis 122, as indicated by arrow 112, and loadstop paddles 140 are rotated into the media path. In one implementation, cam gear member 160 is rotated in one direction (e.g., counter-clockwise in the orientation illustrated) such that loadstop shaft 120 (and loadstop paddles 140) is rotated in an opposite direction (e.g., clockwise in the orientation illustrated).

Figure 4:
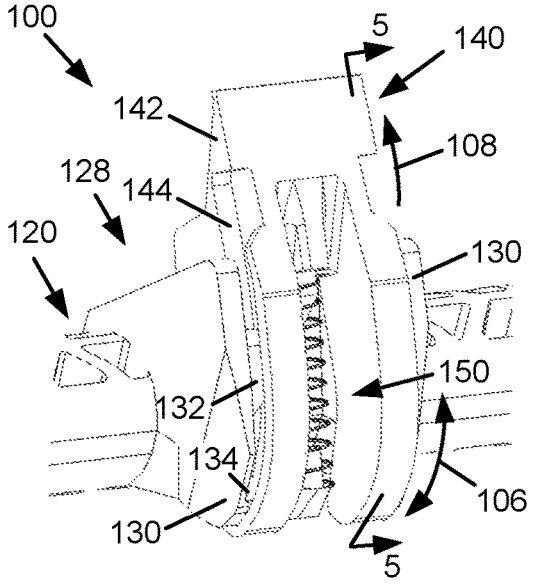
FIG. 4 illustrates an example of a portion of the media retraction system of FIG. 3.
Figure 5:
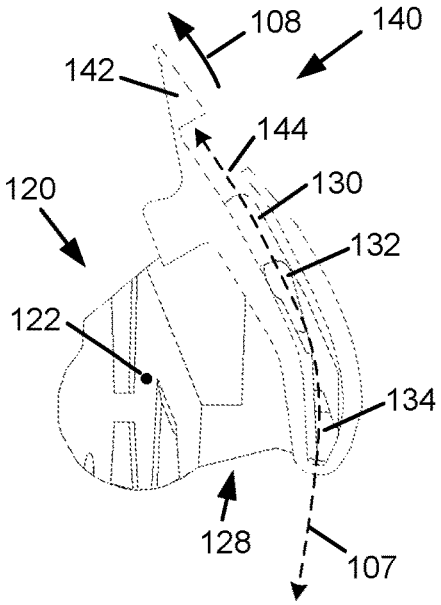
FIG. 5 is a cross-sectional view from the perspective of line 5-5 of FIG. 4.
Figure 6:
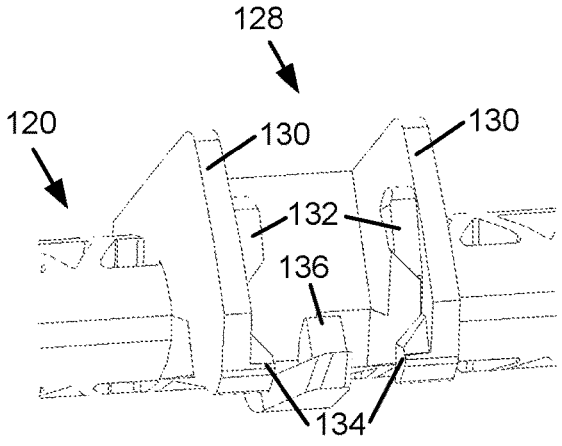
FIG. 6 illustrates an example of a portion of a loadstop shaft of the media retraction system of FIG. 3.
Figure 7:
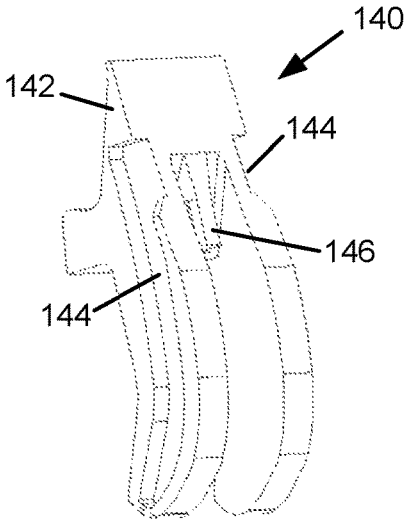
FIG. 7 illustrates an example of a loadstop paddle of the media retraction system of FIG. 3.

In one example, as loadstop paddles 140 are rotated into the media path, loadstop paddles 140 including, more specifically, tips 142 of loadstop paddles 140, contact next-to-top sheet 62, including a bottom surface and/or leading edge of next-to-top sheet 62. In one example, as loadstop paddles 140 contact next-to-top sheet 62, loadstop paddles 140 slide within pockets or channels 128 against the biasing force produced, for example, by spring 150 (FIG. 4). As such, loadstop paddles 140 retract within pockets or channels 128, as indicated by arrow 114. In one example, sliding and retracting of loadstop paddles 140 within pockets or channels 128 helps to absorb energy of the contact of loadstop paddles 140 with next-to-top sheet 62 and minimize damage to next-to-top sheet 62 including, for example, damage to a leading edge of next-to-top sheet 62.

Figure 8C:
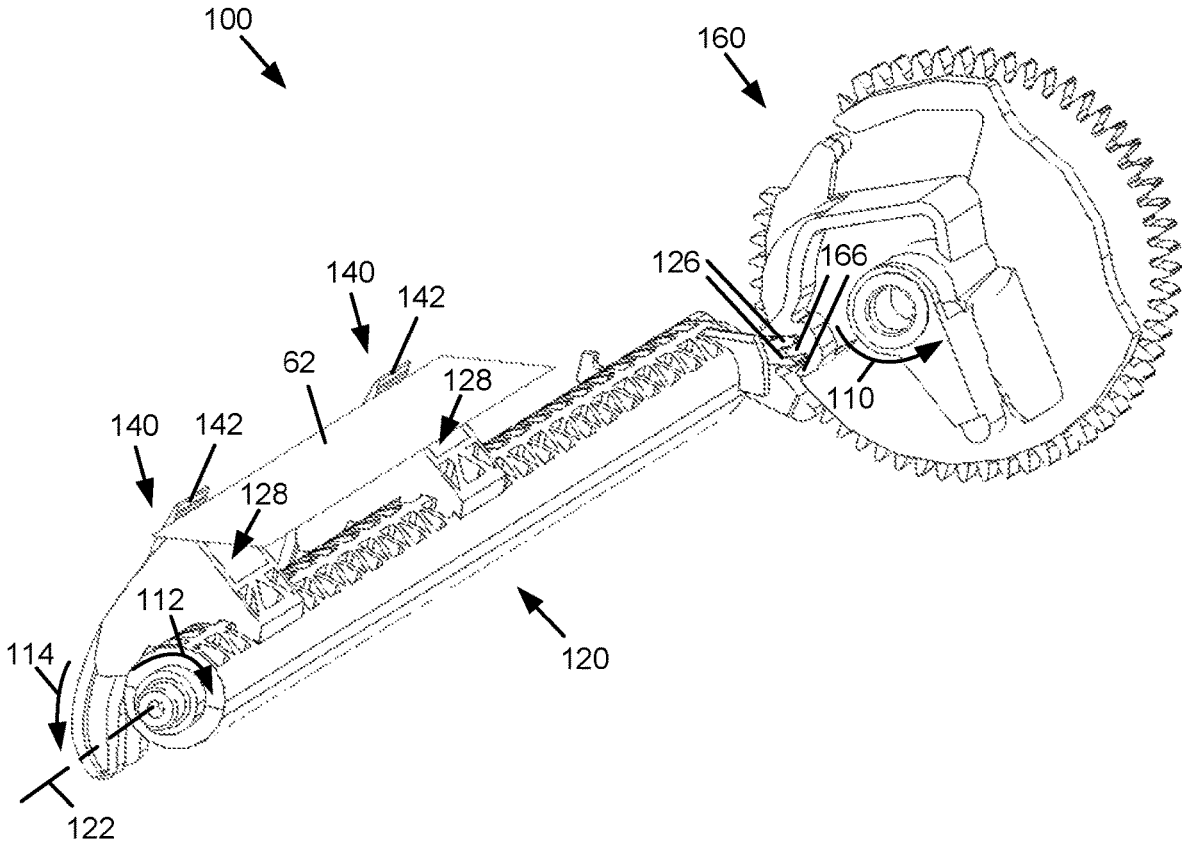

In one example, as illustrated in FIG. 8C, to continue the sequence of media retraction system 100 in retracting next-to-top sheet 62 and returning next-to-top sheet 62 to the media stack, cam gear member 160 is further rotated. In one example, as cam gear member 160 is further rotated, as indicated by arrow 110, gear teeth 166 of cam gear member 160 continue to engage and mesh with gear teeth 126 of loadstop shaft 120 such that loadstop shaft 120 is further rotated about axis 122, as indicated by arrow 112. In one example, as loadstop shaft 120 is further rotated, loadstop paddles 140 including, more specifically, tips 142 of loadstop paddles 140 catch or contact the leading edge of next-to-top sheet 62. In one example, as loadstop paddles 140 catch or contact the leading edge of next-to-top sheet 62, loadstop paddles 140 continue to slide within pockets or channels 128 against the biasing force produced, for example, by spring 150 (FIG. 4). As such, loadstop paddles 140 further retract within pockets or channels 128, as indicated by arrow 114.

Figure 8D:
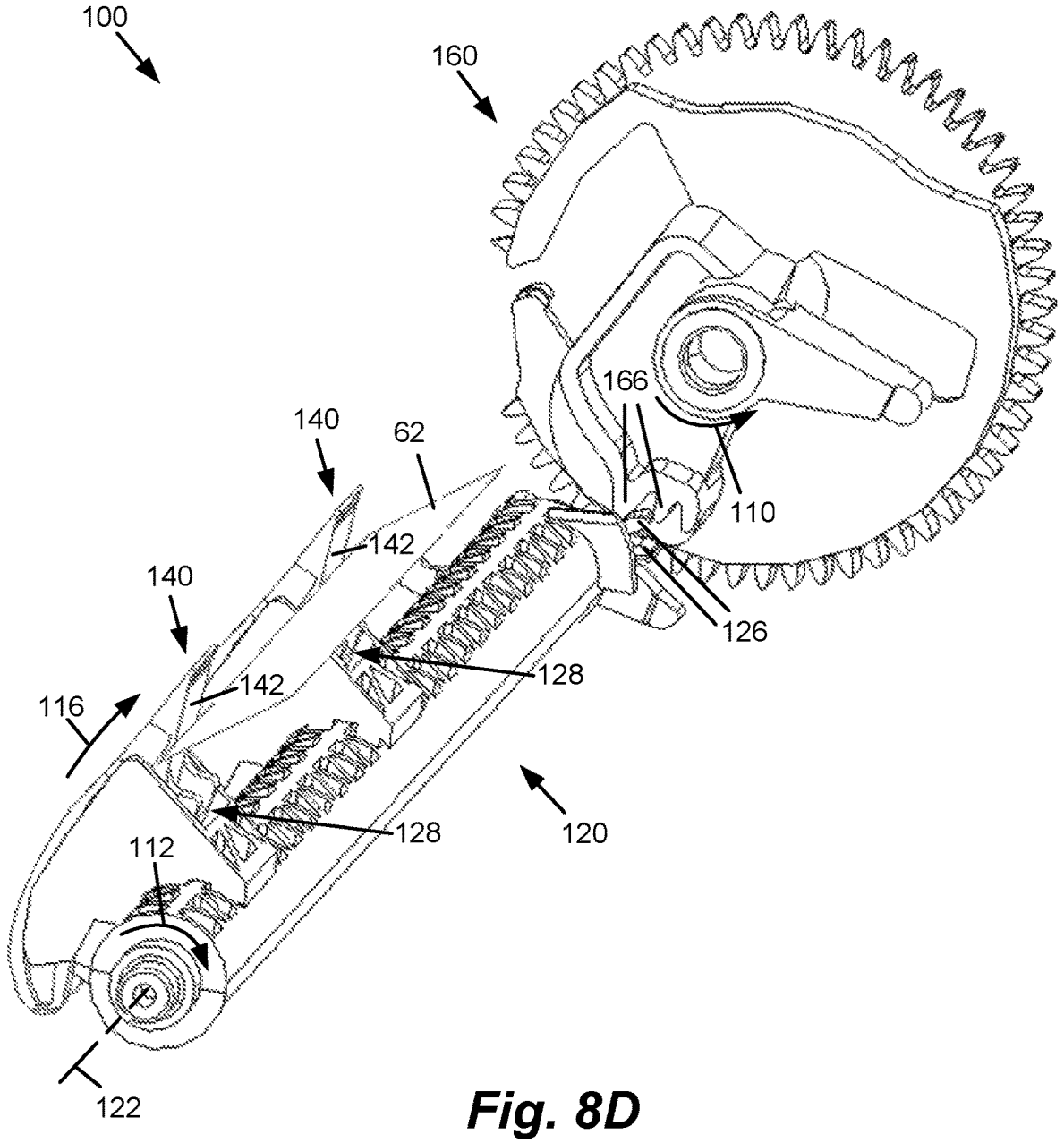

In one example, as illustrated in FIG. 8D, to continue the sequence of media retraction system 100 in retracting next-to-top sheet 62 and returning next-to-top sheet 62 to the media stack, cam gear member 160 is further rotated. In one example, as cam gear member 160 is further rotated, as indicated by arrow 110, gear teeth 166 of cam gear member 160 continue to engage gear teeth 126 of loadstop shaft 120 such that loadstop shaft 120 is further rotated about axis 122, as indicated by arrow 112. In one example, as loadstop shaft 120 is further rotated, loadstop paddles 140 push next-to-top sheet 62 back into the media stack. In one example, as loadstop paddles 140 push next-to-top sheet 62 back into the media stack, loadstop paddles 140 slide within pockets or channels 128 as a result of the biasing force produced, for example, by spring 150. As such, loadstop paddles extend from pockets or channels 128, as indicated by arrow 116.

Figure 8E:
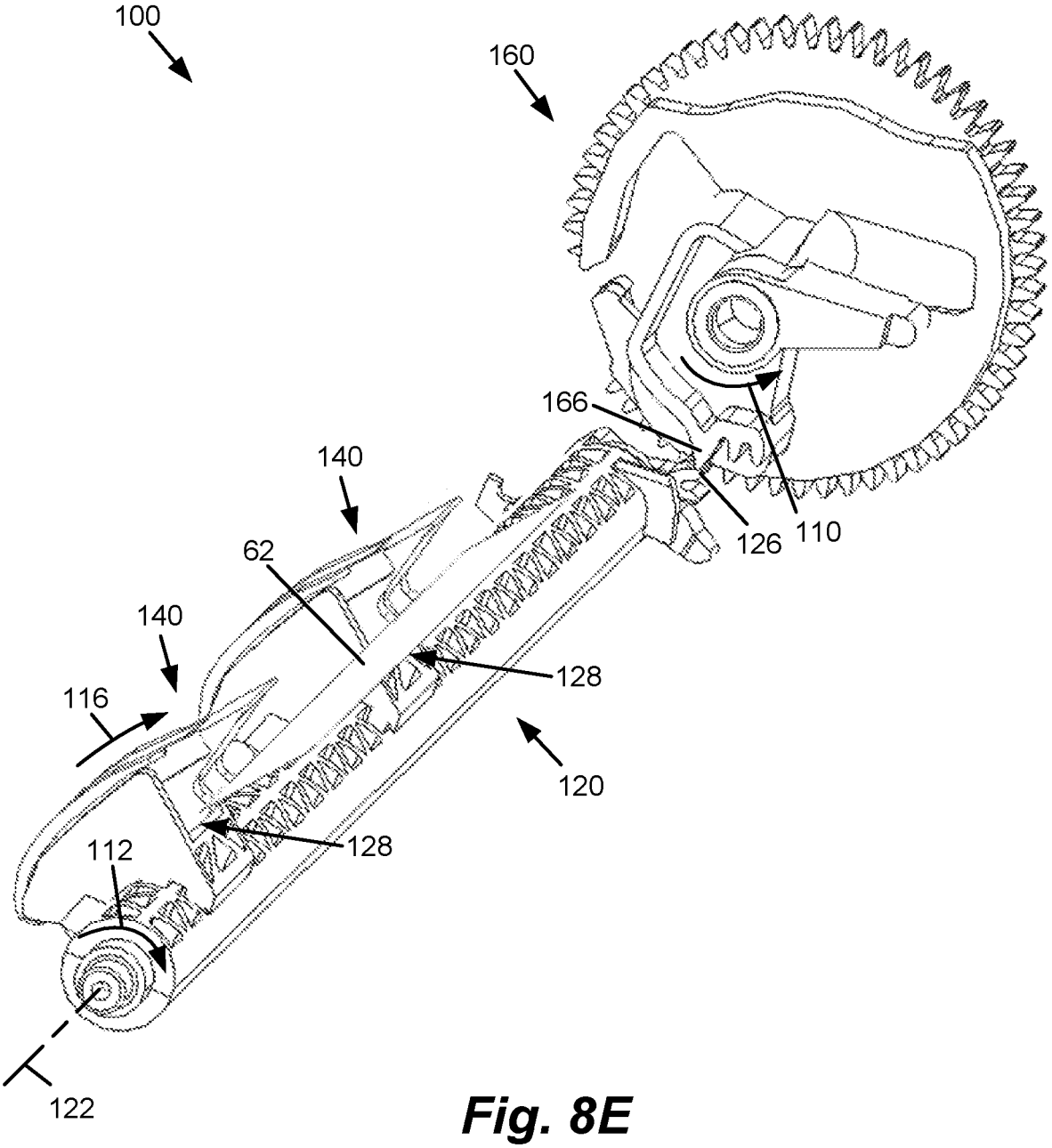

In one example, as illustrated in FIG. 8E, to finish the sequence of media retraction system 100 in retracting next-to-top sheet 62 and returning next-to-top sheet 62 to the media stack, cam gear member 160 is further rotated. In one example, as cam gear member 160 is further rotated, as indicated by arrow 110, gear teeth 166 of cam gear member 160 continue to engage gear teeth 126 of loadstop shaft 120 such that loadstop shaft 120 is further rotated about axis 122, as indicated by arrow 112. In one example, as loadstop shaft 120 is further rotated, loadstop paddles 140 further push next-to-top sheet 62 back into the media stack. In one example, as loadstop paddles 140 further push next-to-top sheet 62 back into the media stack, loadstop paddles 140 continue to slide within pockets or channels 128 as a result of the biasing force produced, for example, by spring 150 (FIG. 4). As such, loadstop paddles further extend from pockets or channels 128, as indicated by arrow 116.

In one example, after next-to-top sheet 62 is returned to the media stack, cam gear member 160 holds loadstop paddles 140 in a position to obstruct the media path and prevent media from entering the media path, until a subsequent pick cycle is started. In one example, prior to the subsequent pick cycle, cam gear member 160 is further rotated in the direction indicated by arrow 110 such that gear teeth 166 of cam gear member 160 no longer engage gear teeth 126 of loadstop shaft 120. As such, loadstop shaft 120 rotates in a direction opposite the direction indicated by arrow 112 whereby loadstop paddles 140 are retracted to the non-obstructing position, as illustrated, for example, in FIG. 8A.

Figure 9A:
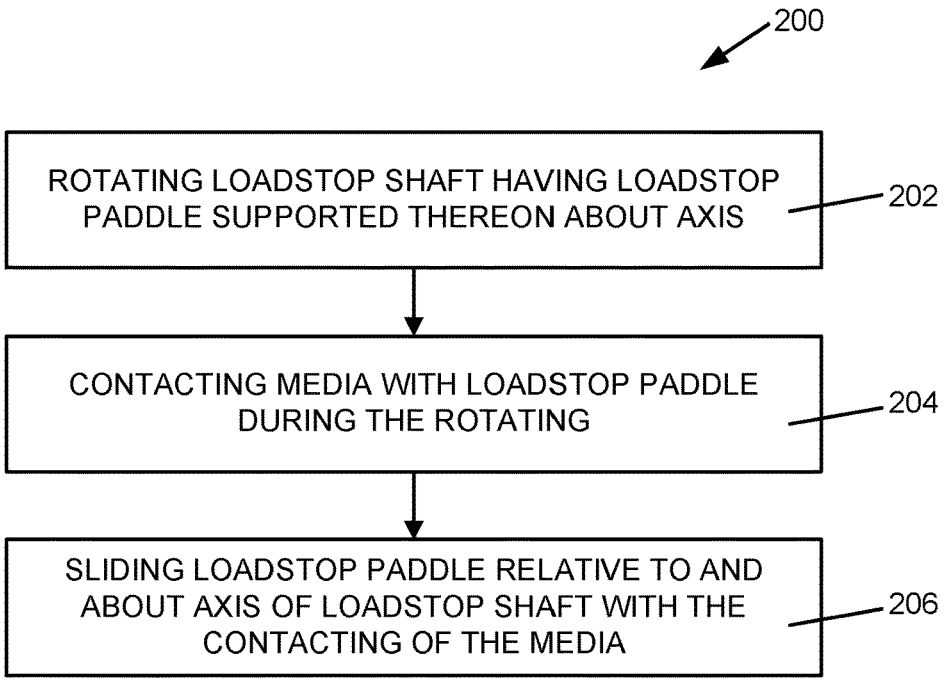
FIGS. 9A, 9B, 9C are flow diagrams illustrating an example of a method of retracting media in a printing system.
Figure 9B:
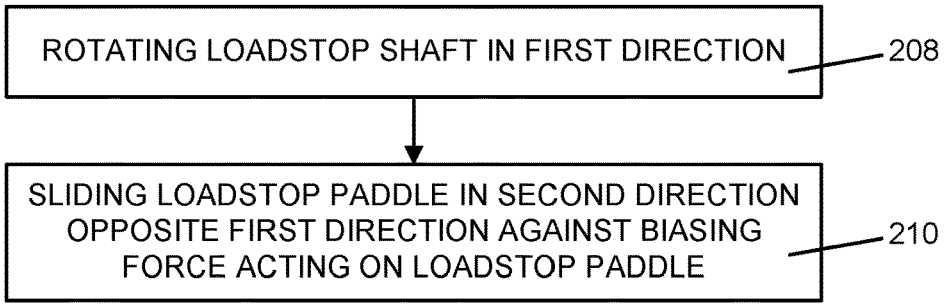
Figure 9C:
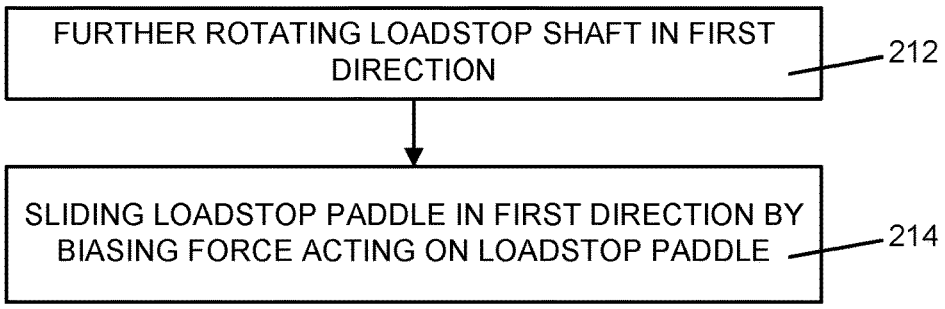

FIGS. 9A, 9B, 9C are flow diagrams illustrating an example of a method 200 of retracting media in a printing system, as illustrated, for example, in FIGS. 8B, 8C, 8D, 8E.

In one example, as illustrated in FIG. 9A, at 202, method 200 includes rotating a loadstop shaft, such as loadstop shaft 120, having a loadstop paddle supported thereon, such as loadstop paddle 140, about an axis, such as axis 122, as illustrated, for example, in FIGS. 8B, 8C, 8D, 8E.

As such, at 204, method 200 includes contacting media, such as next-to-top sheet 62, with the loadstop paddle, such as loadstop paddle 140, during the rotating, as illustrated, for example, in FIGS. 8B, 8C, 8D, 8E.

As such, at 206, method 200 includes sliding the loadstop paddle, such as loadstop paddle 140, relative to and about the axis of the loadstop shaft, such as axis 122 of loadstop shaft 120, with the contacting of the media, as illustrated, for example, in FIGS. 8B, 8C, 8D, 8E.

In one example, as illustrated in FIG. 9B, at 208, with method 200, rotating the loadstop shaft, for example, at 202, includes rotating the loadstop shaft, such as loadstop shaft 120, in a first direction, such as that indicated by arrow 112, as illustrated, for example, in FIGS. 8B, 8C.

As such, at 210, with method 200, sliding the loadstop paddle, for example, at 206, includes sliding the loadstop paddle, such as loadstop paddle 140, in a second direction opposite the first direction, such as that indicated by arrow 114, against a biasing force acting on the loadstop paddle, as illustrated, for example, in FIGS. 8B, 8C.

In one example, as illustrated in FIG. 9C, at 212, with method 200, rotating the loadstop shaft, for example, at 202, includes further rotating the loadstop shaft, such as loadstop shaft 120, in the first direction, such as that indicated by arrow 112, as illustrated, for example, in FIGS. 8D, 8E.

As such, at 214, with method 200, sliding the loadstop paddle, for example, at 206, further includes sliding the loadstop paddle, such as loadstop paddle 140, in the first direction, such as that indicated by arrow 116, by the biasing force acting on the loadstop paddle, as illustrated, for example, in FIGS. 8D, 8E.

With a media retraction system as disclosed herein, an inadvertently "picked" or "fed" sheet of media from a media stack may be cleared from a media path by catching or gathering the sheet of media and retracting or returning the sheet of media to the media stack. By clearing such mis-picked or misfed media, a sheet misfeed during a next pick cycle may be avoided.

More specifically, with a media retraction system as disclosed herein, supporting the loadstop paddles such that the loadstop paddles slide and are biased relative to the loadstop shaft helps to absorb energy of the contact of the loadstop paddles with the sheet being retracted, thereby helping to minimize damage to the retracted sheet including, for example, a leading edge of the retracted sheet.

In addition, with a media retraction system as disclosed herein, supporting the loadstop paddles such that the loadstop paddles slide and are guided with a non-linear profile helps vary the position of the loadstop paddles relative to the sheet being retracted. For example, the non-linear profile helps to initially position the loadstop paddles, including, more specifically, the tips of the loadstop paddles, at an increased or inclined angle of contact to the sheet being retracted so as to better "catch" or gather the sheet being retracted (e.g., FIG. 8A). In addition, as the loadstop paddles continue to gather the sheet being retracted, the non-linear profile helps to subsequently position the loadstop paddles, including, more specifically, the tips of the loadstop paddles, at an orthogonal angle of contact to the sheet being retracted (e.g., generally perpendicular to the leading edge of the sheet) so as to effectively transmit torque of the loadstop paddles without damaging the media (e.g., FIG. 8B). In this regard, the non-linear profile may be "tuned" or "engineered" such that the torque associated with gathering mis-picked media may be more evenly distributed throughout the rotation of the loadstop paddles. The non-linear profile also permits the loadstop paddles to more easily slide within the supporting pockets or channels in the event the loadstop paddles start to bind when contacting the sheet being retracted.

Furthermore, with a media retraction system as disclosed herein, including a gear tooth interface or interaction between the cam gear member and the loadstop shaft helps to provide a rotationally constant speed relative to the mating surfaces such that torque of the cam gear member is more evenly distributed through the rotation of the cam gear member and more efficiently transmitted to the loadstop shaft.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein.

The invention claimed is:

1. A media retraction system, comprising:

a loadstop shaft rotatable about an axis thereof; and a loadstop paddle rotatably coupled with and slidably mounted on the loadstop shaft, the loadstop shaft including a channel defined by spaced supports extended from the loadstop shaft, the loadstop paddle mounted within the channel and slidable relative to the loadstop shaft within the channel between the spaced supports about the axis of the loadstop shaft.

2. The system of claim 1, wherein the loadstop paddle is slidable relative to the loadstop shaft about the axis of the loadstop shaft in a non-linear path.

3. The system of claim 1, wherein a tip of the loadstop paddle is radially biased away from the axis of the loadstop shaft by a bias force.

4. The system of claim 3, wherein, with rotation of the loadstop shaft and contact of the loadstop paddle with media, the loadstop paddle is slidable relative to the loadstop shaft against the bias force, and wherein, with further rotation of the loadstop shaft and further contact of the loadstop paddle with the media, the loadstop paddle is slidable relative to the loadstop shaft with the bias force.

5. The system of claim 3, wherein, with rotation of the loadstop shaft and contact of the loadstop paddle with media, the tip of the loadstop paddle is initially positioned at an inclined angle of contact to the media and is subsequently positioned at an orthogonal angle of contact to the media.

6. The system of claim 3, further comprising:

a spring positioned between the loadstop shaft and the loadstop paddle to produce the bias force.

7. The system of claim 6, wherein the spring contacts a portion of the loadstop shaft and a portion of the loadstop paddle.

8. The system of claim 1, wherein the channel is oriented orthogonal to and radially offset from the axis of the loadstop shaft.

9. The system of claim 1, wherein the loadstop paddle includes a slot formed in an outer side surface thereof and the channel includes a tab protruded from an inner side surface thereof, wherein the tab mates with the slot to slidably guide the loadstop paddle within the channel.

10. A media retraction system, comprising:

a cam gear member including a cam surface and gear teeth;

a loadstop shaft including a lever arm and gear teeth to interact with the cam surface and the gear teeth of the cam gear member to rotate and position the loadstop shaft, the loadstop shaft including a channel defined by spaced supports extended from the loadstop shaft; and a loadstop paddle mounted within the channel of the loadstop shaft, the loadstop paddle to rotate with the loadstop shaft and slide relative to the loadstop shaft within the channel between the spaced supports.

11. The system of claim 10, wherein the loadstop shaft is to rotate in a first direction to retract media, wherein the loadstop paddle is to rotate in the first direction with the loadstop shaft, and wherein the loadstop paddle is biased in the first direction within the channel.

12. The system of claim 11, wherein, with rotation of the loadstop shaft in the first direction and contact of the loadstop paddle with the media, the loadstop paddle is to slide relative to the loadstop shaft within the channel in a second direction opposite the first direction.

13. The system of claim 12, wherein, with further rotation of the loadstop shaft in the first direction and further contact of the loadstop paddle with the media, the loadstop paddle is to slide relative to the loadstop shaft within the channel in the first direction.

14. The system of claim 11, further comprising:

a spring positioned between the loadstop shaft and the loadstop paddle to bias the loadstop paddle in the first direction, the spring positioned within the channel between the spaced supports.

15. The system of claim 14, wherein the spring contacts a portion of the loadstop shaft and a portion of the loadstop paddle.

16. A media retraction method, comprising:

rotating a loadstop shaft having a loadstop paddle supported thereon about an axis, the loadstop paddle mounted within a channel defined by spaced supports extended from the loadstop shaft;

contacting media with the loadstop paddle during the rotating; and with the contacting of the media, sliding the loadstop paddle relative to the loadstop shaft about the axis of the loadstop shaft within the channel between the spaced supports.

17. The method of claim 16, wherein rotating the loadstop shaft includes rotating the loadstop shaft in a first direction, and wherein sliding the loadstop paddle relative to the loadstop shaft includes sliding the loadstop paddle in a second direction opposite the first direction against a biasing force acting on the loadstop paddle.

18. The method of claim 17, wherein rotating the loadstop shaft includes further rotating the loadstop shaft in the first direction, and wherein sliding the loadstop paddle relative to the loadstop shaft further includes sliding the loadstop paddle in the first direction by the biasing force acting on the loadstop paddle.

19. The method of claim 17, wherein the biasing force acting on the loadstop paddle comprises a spring positioned between the loadstop shaft and the loadstop paddle.

20. The method of claim 16, wherein rotating the loadstop shaft includes moving the loadstop paddle between a non-obstructing position to allow media to enter a media path, a plurality of retracting positions to retract media into a media tray, and an obstructing position to prevent media from entering the media path.

* * * * *